United States Patent [19]

Kodera

[11] Patent Number: 4,573,818

[45] Date of Patent: Mar. 4, 1986

[54] CAP ASSEMBLY FOR A SINGLE OR PLURAL WRITING INSTRUMENTS

[75] Inventor: Kimio Kodera, Tokyo, Japan

[73] Assignee: Platinum Pen Co., Ltd., Tokyo, Japan

[21] Appl. No.: 681,573

[22] Filed: Dec. 13, 1984

[30] Foreign Application Priority Data

Feb. 29, 1984 [JP] Japan ..... 59-27438[U]

[51] Int. Cl.[4] ..... B43K 9/00

[52] U.S. Cl. ..... 401/131; 24/11 R; 24/11 P; 211/69.1; 401/17; 401/35; 401/202; 401/213; 401/243; 401/245; 401/246; 401/247

[58] Field of Search ..... 211/69.1, 69.5, 69.6, 211/69.8, 69.9; 24/11 R, 11 CC, 11 HC, 11 P; 401/17, 35, 131, 202, 213, 243, 247, 245, 246

[56] References Cited

U.S. PATENT DOCUMENTS

| | | | |
|---|---|---|---|
| 1,697,545 | 1/1929 | Smith | 24/11 P |
| 2,343,058 | 2/1944 | Hasselquist | 24/11 P |
| 3,724,676 | 4/1973 | Anderka | 211/69.8 X |
| 3,862,683 | 1/1975 | Koelichen | 211/69.5 X |
| 4,415,092 | 11/1983 | Boyer | 211/69.1 |

FOREIGN PATENT DOCUMENTS

| | | | |
|---|---|---|---|
| 2514041 | 10/1976 | Fed. Rep. of Germany | 24/11 R |
| 2711441 | 9/1978 | Fed. Rep. of Germany | 401/131 |
| 7506935 | 1/1976 | Netherlands | 401/202 |

*Primary Examiner*—Steven A. Bratlie

*Attorney, Agent, or Firm*—Cushman, Darby & Cushman

[57] ABSTRACT

A modular writing instrument cap system is disclosed, in which each individual cap comprises an elongated tubular portion having an open end and a closed end. Near the closed end the cap is internally provided with a seal member adapted to seal with a writing instrument holding quick-drying ink. Near the open end, the tubular portion is internally provided with a catch for removably securing the cap on a writing instrument. Externally on the closed end, the cap is provided with a transversely-oriented open ended tubular barrel. The barrel is configured to receive an internally threaded sleeve, terminator rings and screws which thread towards one another through the rings into the opposite ends of the sleeve in order to hold the assembly together and secure a bail to it. The ends of the barrel and corresponding ends of the terminator rings are cooperatively notched to accommodate the legs of the bail. In order to create an assembly of two or more caps, the barrels of a respective number of caps are butted end to end, a tubular sleeve of appropriate length is slid into their barrels, and terminator rings, screws and a shared bail are secured together, uniting the cap assembly. The bail can be tightened down to act as a pocket clip, or up to act as a hanger.

5 Claims, 6 Drawing Figures

CAP ASSEMBLY FOR A SINGLE OR PLURAL WRITING INSTRUMENTS

BACKGROUND OF THE INVENTION

When a plurality of writing instruments is to be carried by a user, it has hitherto been the practice to place them in a box or case in order to keep them from becoming damaged or lost. Sometimes the use of a box or case is inconvenient because of bulkiness. In order to overcome this problem, others have proposed to connect the caps of several writing instruments together in a row either by molding them together in a unitary block, or detachably securing them together such as is disclosed in Japanese Utility Model Publication No. 5606/66, for example. These known proposals have been subject to several shortcomings. The unitary blocks are not very versatile; the mold that makes them is set-up to mold a block having a certain number of united caps in a row, no more and no less. This is satisfactory only where the user is content to have a set containing that particular number of writing instruments. The sets of conventional detachably secured caps have been subject to coming apart at inconvenient times. And the known cap sets have not had their individual caps adaptable to alternative use with both writing instruments filled with quick drying inks, which need to be sealingly capped when not in use, and writing instruments filled with pencil lead, non-water base ballpoint pen ink, fountain pen ink and the like, none of which require sealing caps and at least some of which can benefit from cap ventilation when not in use.

SUMMARY OF THE INVENTION

A modular writing instrument cap system is disclosed, in which each individual cap comprises an elongated tubular portion having an open end and a closed end. Near the closed end the cap is internally provided with a seal member adapted to seal with a writing instrument holding quick-drying ink. Near the open end, the tubular portion is internally provided with a catch for removably securing the cap on a writing instrument. Externally on the closed end, the cap is provided with a transversely-oriented open ended tubular barrel. The barrel is configured to receive an internally threaded sleeve, terminator rings and screws which thread towards one another through the rings into the opposite ends of the sleeve in order to hold the assembly together and secure a bail to it. The ends of the barrel and corresponding ends of the terminator rings are cooperatively notched to accommodate the legs of the bail. In order to create an assembly of two or more caps, the barrels of a respective number of caps are butted end to end, a tubular sleeve of appropriate length is slid into their barrels, and terminator rings, screws and a shared bail are secured together, uniting the cap assembly. The bail can be tightened down to act as a pocket clip, or up to act as a hanger.

The principles of the invention will be further discussed with reference to the drawings wherein preferred embodiments are shown. The specifics illustrated in the drawings are intended to exemplify, rather than limit, aspects of the invention as defined in the claims.

DETAILED DESCRIPTION

Figure 1:
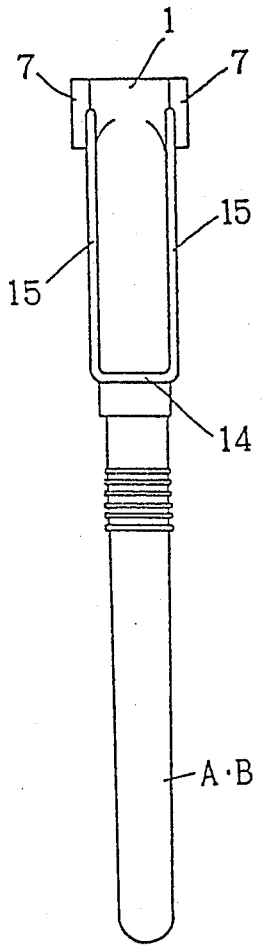
FIG. 1 is a front elevation view of an embodiment of a single writing instrument capped by an individual cap embodying principles of the present invention.
Figure 2:
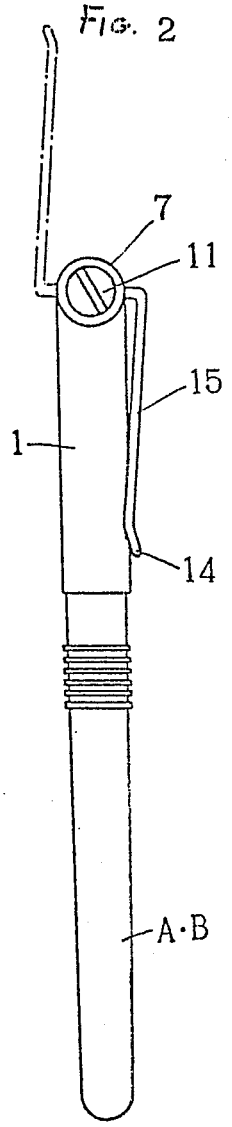
FIG. 2 is a side elevation view of the capped writing instrument of FIG. 1, showing two alternative positions of the bail, respectively in solid and phantom lines.

In FIGS. 1 and 2, a writing instrument A.B is shown removably provided with a cap 1 which includes a tubular portion open at one end and closed at the opposite end by a transversely extending tubular barrel which is open at both ends. (The designator "A.B" is used for the writing instrument per se for emphasizing that it could be a fiber-tipped pen or other writing instrument A having quick-drying ink and needing a cap seal, or a fountain pen B, mechanical pencil or the like not needing a cap seal, see FIG. 6.)

Figure 6:
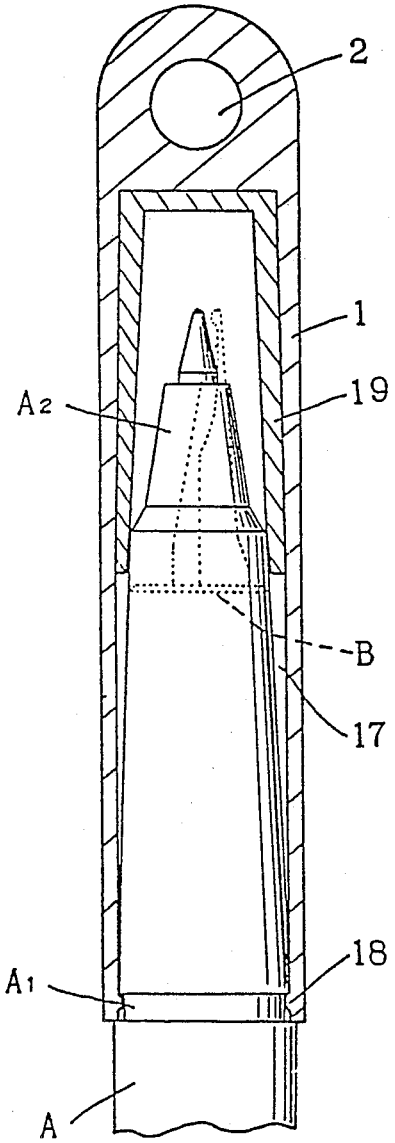
FIG. 6 is a fragmentary enlarged side elevation view of a writing instrument capped with a cap embodying principles of the present invention, the cap being shown in longitudinal section and minus the cap assembly uniting/terminating structures.
Figure 4:
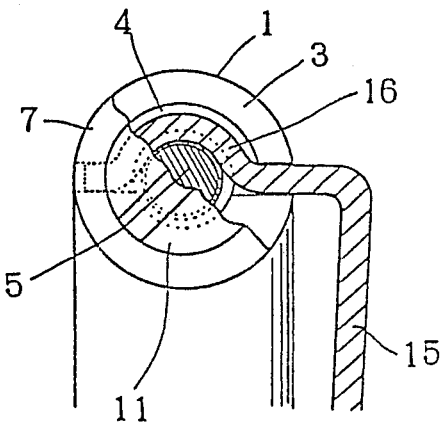
FIG. 4 is a fragmentary enlarged side elevation view of the closed end of a cap, with some parts partially cut away and sectioned to expose internal details.
Figure 5:
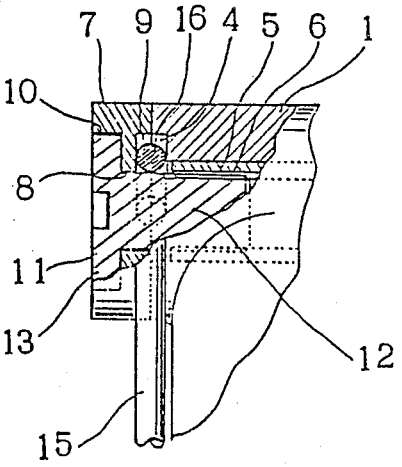
FIG. 5 is a fragmentary enlarged scale front elevation view of the closed end of a cap, with some parts partially cut away and sectioned to expose internal details.

Referring now to FIGS. 4–6 in association with FIGS. 1 and 2 for understanding more details of the cap construction and cap/writing instrument association, the open ended tubular barrel of the cap 1 is shown provided with a bore 2 which is enlarged in an abrupt manner adjacent each end 3, semi-circumferentially, to produce a groove at 4, with radially outwardly extending end portions that emerge to the exterior of the cap 1.

Figure 3:
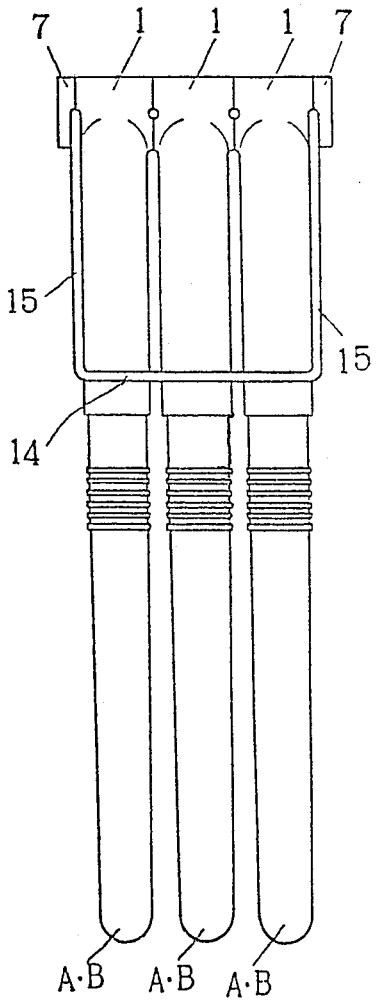
FIG. 3 is a front elevation view similar to FIG. 1, but of an embodiment where a plurality, e.g. three caps are ganged together with a common bail.

The cap 1 is shown further provided with terminator rings 7 which are adapted to abut opposite ends of the barrel of the cap 1 (as in FIG. 1), or the two opposite ends of a series of caps 1 having abutted barrels (as in FIG. 3). Each terminator ring 7 is shown provided with a bore 8 which is abruptly enlarged near its axially inner end by a semi-circumferential groove 9 with two diametically-opposed radially outwardly directed extensions to the exterior of the respective terminator ring 7. Each bore 8 also is shown abruptly enlarged near its axially outer end to provide a circumferential recess 10.

The grooves 4 and 9 match and are equally deep, so that when the terminator rings 7 are abutted with opposite ends of a barrel or set of barrels, the respective groove 4 and groove 9 at each end cooperate to form a generally omega-shaped passageway.

The bore 2 of the barrel, (or the composite bore resulting from coaxially aligned abutment of a plurality of the barrels) is adapted to slidingly receive a tubular sleeve 5 which is internally provided with a band of threading 6 adjacent each end thereof. Where the sleeve 5 is designed for use in one cap 1, it is made sufficiently long as to terminate just short of the grooves 4 at opposite ends. Where the sleeve 5 is designed for use extending through a plurality of caps, it is made sufficiently long as to terminate just short of the grooves 4 at opposite ends of the assembly of barrel-abutted caps. (As a presently less-preferred alternative, when several caps are to be ganged together, the barrels of the caps at the two ends can be provided with individual-sized sleeves 5, in place of one long sleeve 5 extending through all of the cap barrels. This alternative is less preferred because not so great structural stability is thereby provided for the multiple cap assembly.)

In assembling a cap 1 as in FIG. 1, or a set of caps as in FIG. 3, an appropriate bail 14 is selected. The only difference between the various bails 14 is the length of the cross-arm extending between the legs 15 of its generally U-shaped structure. Each bail leg, near its free end is bent so as to have a generally rearwardly directed-omega shaped portion, e.g. having a generally semi-circular hump 16 which is sized and shaped to be snuggly received in a passageway formed by a respective pair of confronting grooves 4 and 9.

Accordingly, a bail 14 of proper width is selected and installed in the grooves 4 at opposite ends of the cap barrel or series of cap barrels and two terminator rings 7 are put in place, one at each end.

Finally, a screw 11 having an externally threaded shank 12 is inserted in through the terminator ring 7 at each end and screwed into the threading 6 at the end of the tube 5 or the respective tubes 5. The enlarged head 13 of each screw 11 becomes socketed in the respective groove 10 as that screw is tightened into the respective tube 5.

If the screws 11 are tightened while the bail 14 lies folded flat against the cap or cap set as shown in full lines in FIGS. 1–5, the bail is arranged to act as a pocket clip, but if the screws 11 are tightened while the bail is directed upwards, e.g. as shown in phantom lines in FIG. 2, then, the bail 14 is arranged to act as a hanger for the cap or set of caps and the associated one or more writing instruments A.B. The bail 14 may be shifted from one disposition to the other by the user, simply by temporarily loosening the screws 11 a little, rotating the bail from one position to the other, and retightening the screws.

Each cap 1 preferably is provided with internal structure such as is illustrated in FIG. 6. In FIG. 6, the cap 1 is shown having a longitudinal bore which is open at one end and closed at the other. Near the open end the bore 17 is shown provided with a slight circumferential band of construction 18 which is adapted to snap into a corresponding groove, e.g. the groove $A_1$ on the barrel of the writing instrument A for tightly but removably holding the cap in place on the writing instrument telescopically covering its working end.

The closed end of the interior of the bore 17 is shown frictionally receiving and maintaining in place a thimble-like seal element which is shorter than the cap, but has a closed end, and a sidewall 19, the lower, inner surface of which is tapered to provide a surface-to-surface seal with a corresponding circumferential band of a shoulder part of the working end $A_2$ of a writing instrument of the type which uses fast-drying ink, e.g. a fiber tip pen.

Should the writing instrument inserted and snapped into the cap 1 of FIG. 6 instead be one not having a fast drying ink, e.g. and instead be a mechanical pencil, or a fountain pen, typically it can be provided with an axially shorter shoulder, as shown in phantom lines at B, so that whereas the seal 19 may be provided or omitted in such a case, even when it is provided, it need not be used. Either type of writing instrument thus may be removably inserted and snapped into any one of the caps 1.

In preferred practices of the present invention, the bail 14 is made of a metal such as stainless steel, and the other parts of the cap or set of caps are injection molded of the same sort of synthetic plastic resin material as is presently conventionally used in the manufacture of low cost writing instruments, e.g. an ABS copolymer.

It should now be apparent that the cap assembly for writing instruments, as described hereinabove, possesses each of the attributes set forth in the specification under the heading "Summary of the Invention" hereinbefore. Because it can be modified to some extent without departing from the principles thereof as they have been outlined and explained in this specification, the present invention should be understood as encompassing all such modifications as are within the spirit and scope of the following claims.

What is claimed is:

1. A modular writing instrument cap system, comprising:

at least one cap including a tubular sidewall having one open end and an opposite end closed by a transversely-oriented tubular barrel which includes a transversely-oriented bore that is open at both ends;

means on said cap sidewall constructed and arranged for removably securing the cap on a writing instrument in telescopically enclosing relation to a working end of such writing instrument;

said barrel being coaxially abuttable end-to-end with corresponding barrels of like caps to provide a series of adjoining caps, effectively having a shared transversely-oriented bore, and an exposed barrel end at each end of such series;

a generally U-shaped bail, including a cross-arm and two generally parallel legs, each leg having a free end portion which is bent back generally at approximately a right angle and includes intermediate its extent an at least generally semi-circular hump, so that each such free end portion is generally omega-shaped;

each end of each said barrel having means defining a correspondingly omega-shaped groove formed therein so as to open axially outwardly thereof;

a pair of terminator rings each having a corresponding omega-shaped groove formed therein so as to open axially inwardly therefrom; each bail free end portion being received in a passageway defined by confrontation of a respective said omega-shaped groove at a respective exposed barrel end and a respective said omega-shaped groove in a respective said terminator ring;

at least one internally threaded sleeve received in said transversely-oriented bore so as to have one end disposed adjacent a said omega-shaped groove of one said exposed barrel end and another end disposed adjacent a said omega-shaped groove of an opposite said exposed barrel end; and a respective screw bearing from axially outwardly against each terminator ring and having a shank thereof threaded into said at least one sleeve for securing said bail in relation to said at least one cap.

2. The modular writing instrument cap system of claim 1, wherein:

said at least one cap is constituted by only one cap.

3. The modular writing instrument cap system of claim 1, wherein:

said at least one cap is constitued by a plurality of said caps.

4. The modular writing instrument cap system of claim 1, wherein:

said screws are constructed and arranged to be tightened with said bail alternatively in two positions, including one in which the bail is folded against the at least one cap to serve as a pocket clip and another in which the bail extends upwards to serve as a hanger.

5. The modular writing instrument cap system of claim 1, wherein:

each said cap is provided adjacent said closed end thereof with a means for providing a circumferential surface-to-surface seal with a working end-region shoulder of a writing instrument of the type needing sealing protection against premature drying-out of ink, such seal means being constructed and arranged to avoid interference with proper storage of a writing instrument of a type not needing protection against premature drying out of ink, so that both types of writing instrument may be interchangeably stored in each such cap.

* * * * *